US005129653A

United States Patent [19]

Morris et al.

[11] Patent Number: 5,129,653

[45] Date of Patent: Jul. 14, 1992

[54] GOLF PUTTING TRAINER

[75] Inventors: Saul Morris; David Morris, both of Chattanooga, Tenn.

[73] Assignee: Habitat International, Inc., Chattanooga, Tenn.

[21] Appl. No.: 739,101

[22] Filed: Aug. 1, 1991

[51] Int. Cl.[5] ..... A63B 69/36

[52] U.S. Cl. ..... 273/179 C; 273/176 FB

[58] Field of Search ..... 273/179 R, 179 A, 179 B, 273/179 C, 179 D, 179 E, 176 F, 176 FA, 176 FB, 182 R, 182 A, 180

[56] References Cited

U.S. PATENT DOCUMENTS 2,450,125 9/1948 Dunfee ..... 273/182 A X
3,215,436 11/1965 Carter ..... 273/176 F
3,275,325 9/1966 MacKenzie ..... 273/179 C
3,844,558 10/1974 Gigliotti ..... 273/176 F X

*Primary Examiner*—George J. Marlo
*Attorney, Agent, or Firm*—Larson and Taylor

[57] ABSTRACT

A golf putting trainer is provided which is easily transported and erected while also having the ability to return a golf ball directly to a golfer. The golf putting trainer includes a ramp for elevating at least one golf hole, a first gutter around a periphery of the ramp for returning a golf ball, a second gutter having a first end under the hole and a second end in communication with the first gutter for delivering a golf ball which has entered the hole to the first gutter, and a track attached at one end to the first gutter for returning the golf ball to a golfer. A channel in each gutter guides a golf ball in the gutter to the track while conserving its momentum. Additionally, the first gutter includes a thin tongue that attaches the track to the first gutter in a tongue and groove engagement.

20 Claims, 2 Drawing Sheets

GOLF PUTTING TRAINER

FIELD OF THE INVENTION

This invention relates generally to golf practice aids, and more specifically relates to an improved golf putting trainer.

BACKGROUND OF THE INVENTION

The use of off-the-golf course training devices has grown considerably with the popularity and competitiveness of the sport. Three major factors come into play in training aids, their ability to simulate accurately the conditions of a golf course, their ability to be transported and assembled quickly, and their ability to aid the golfer in the collection of golf balls.

Golf devices used by players who wish to perfect their game through practice off the golf course have been known in the prior art. This prior art includes both commercially available devices and patents for such devices. These are discussed below.

The MacKenzie patent (3,275,325) discloses a golf putting trainer comprising an elevated platform, a ramp to access the platform, several golf holes through the platform, an L shaped gutter for returning balls which enter the golf holes, a channel in the ramp for returning golf balls which do not enter the golf holes, and a trough attached to the mouth of the L shaped gutter. In operation a golfer putts a golf ball up the ramp and into one of the golf holes. After the ball enters the hole, it falls through the platform and lands upon the L shaped channel. The ball rolls by gravity to the trough and continues in the general direction of the golfer. If the golf ball fails to enter a golf hole, it rolls back down the ramp and falls into a channel in the ramp. This channel feeds into the L shaped gutter and the balls continues its path as described above. Additionally, the golf ball return system of this device significantly reduces the momentum of the golf ball and thus decreases the distance the golf ball will travel.

The Tierney patent (3,856,313) discloses a golf putting target having a golf carpet, a platform, several golf holes, and gutters located on either side of the platform. This device does not return the golf ball directly to the golfer and thus increases the time required to retrieve the golf balls.

The Hickman patent (4,805,912) discloses a golf putting teaching aid for improving putting skills. This device comprises a golf carpet, a platform, a golf hole through the golf carpet and platform, and an indicating device which is used to coach the golfer how to swing. This device requires the golfer to remove the golf balls from the golf hole and thus increases the time required to use the device.

The Zawacki design patent (D 234,526) illustrates a golf target having a golf carpet attached to a platform. There are several holes of varying diameters through the platform and golf carpet. This device does not return the golf ball to the golfer.

The Portteus patent (3,142,487) discloses a golf return game having a putting area and a ball target and return area. The putting area has a discharge chute which feeds into a tee orifice. Attached to tee orifice is a discharge groove which extends the length of the putting area. The target and return area is a semicircular stop which deflects a golf ball back into the direction of the golfer. This device does not accurately return the golf ball back to the golfer. Thus, considerable time may be spent in the recovery of the golf balls.

The Johnson design patent (D 123,540) illustrates a golf exerciser having an elevated target area and a ball return from the target area. The ball return is a hollow tube that transports balls from a collection area at the target to a holding pen located by the golfer. This device is not readily portable and requires a great deal of time to erect.

The Lagaard design patent (D 83,050) illustrates a golf carpet attached to an elevated platform. There are several golf holes through the golf carpet and platform. There is a chute for returning golf balls which enter the golf holes, but the chute does not return the golf ball directly to the golfer, and thus increases the time and energy required to retrieve golf balls.

The Trangmar patent (2,110,925) discloses a golf putting target comprising a grass carpet attached to a platform. The platform and carpet have a golf hole at the distal end. Located below the hole is a cup for catching the golf ball. Attached to this cup is a channel for returning the golf ball to a collection site near the golfer. This device is not easily portable and requires considerable time to erect.

The commercially sold Kuroco "Puttmaster Boomerang", referenced in the "Morris et al. design patent (D 316,120), discloses a golf putting device having a ramp, a golf hole and cup, an L-shaped gutter along the back and one side of the ramp, and a second gutter from the cup to the L-shaped gutter. The second gutter guides a golf ball falling into the cup to the L-shaped gutter, which in turn guides the ball to a exit at the base of the device. From this point on, there is no guidance for the return of a golf ball. In addition, the rolling momentum and energy of a ball falling into the cup or the L-shaped gutter can be lost by the ball bouncing back and forth between the gutter sides. Therefore, a golf ball may fail to return to the golfer positioned a distance away from the device.

Although all of the above-discussed devices relate to golf putting trainers which have one or more of the disadvantages of not being readily transportable or easily assembled, and requiring additional time to retrieve used golf balls.

SUMMARY OF THE INVENTION

According to the present invention, a golf putting trainer is provided which has the advantages of being easily transported and assembled while also efficiently and successfully returning golf balls to the golfer. The golf putting trainer comprises a ramp for elevating at least one golf hole and a first gutter around at least a part of the periphery of the ramp for collecting and returning a golf ball. A second gutter having a first end under the hole and a second end in communication with the first gutter, delivers a golf ball which has entered the hole to the first gutter. A track is attached at one end to the first gutter and returns the golf ball to a golfer. A guide means in the gutters efficiently guides a golf ball to the track. The guide means minimizes friction and wandering, and helps to conserve the rolling energy and momentum of the golf ball.

The golf putting trainer is easily assembled because a golfer need only place the trainer upon a smooth surface and attach the track to the trainer. Once assembled, the trainer aids the golfer in recovering balls since the balls are accurately returned to the golfer by the track.

Other features and advantages of the invention will be set forth in, or apparent from, the following detailed description of the preferred embodiment of the invention.

DESCRIPTION OF THE PREFERRED EMBODIMENT

Figures 1, 4:
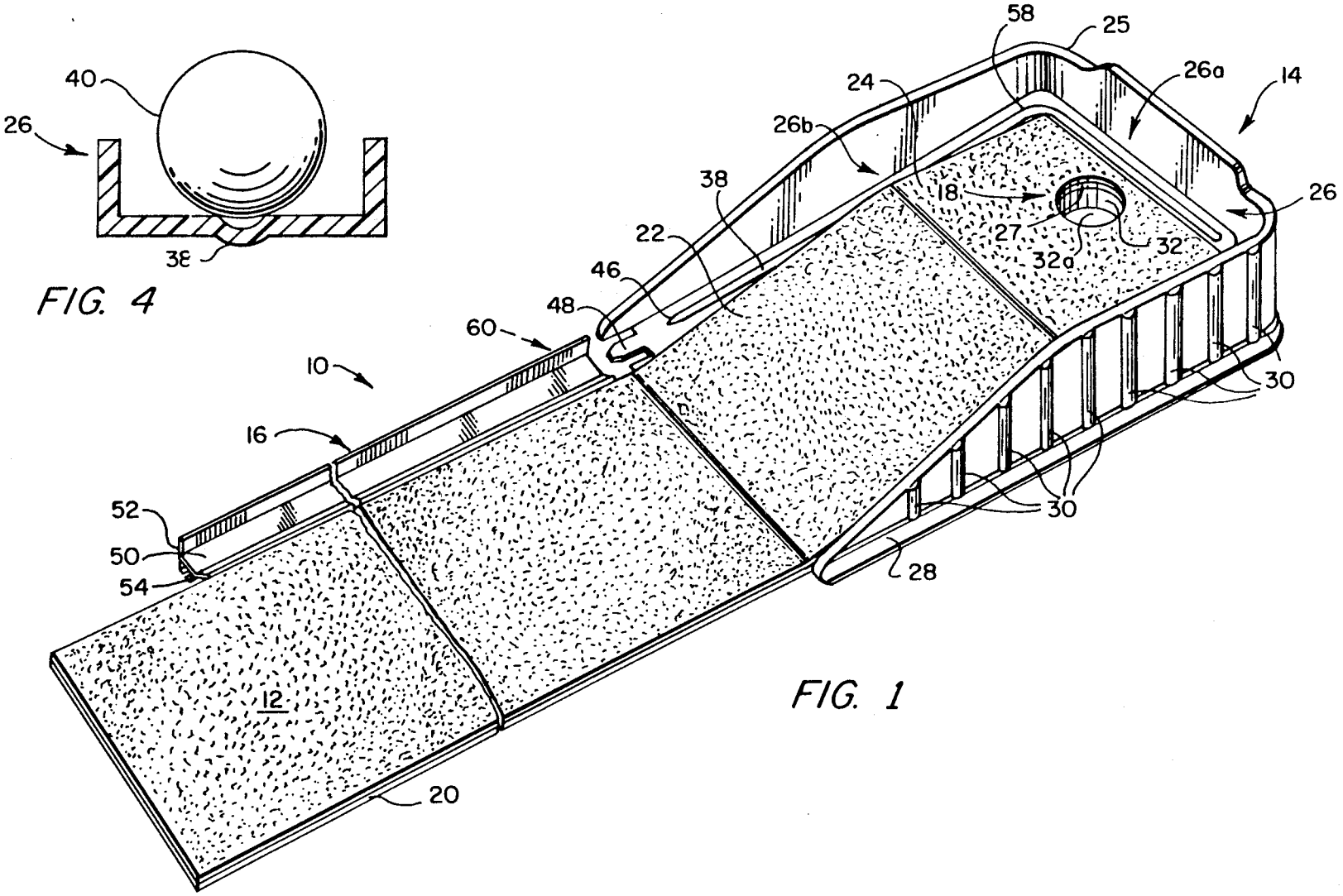
FIG. 1 is a perspective view of a golf putting trainer constructed in accordance with a preferred embodiment of the invention.
FIG. 4 is an enlarged, cross-sectional view taken along lines 4—4 in FIG. 2 of a side gutter of the trainer of FIG. 1 showing the positioning of a golf ball.

Referring to the Figures in which like numerals represent like elements throughout the several views, a golf putting trainer 10 in accordance with a presently preferred embodiment of the invention is shown. Golf putting trainer 10 includes an elongated sheet 12, a target 14, and a ball return track 16.

In a preferred embodiment, elongated sheet 12 is made of a material that provides a frictional surface simulative of grass. Such material is commercially available as a lawn carpet. Elongated sheet 12 has a hole 18 that is located at one end of and through sheet 12. Sheet 12 has a padding layer 20 attached to the underside thereof which can be a conventional foam rubber material. Sheet 12 extends over and is attached to target 14

Target 14 is a one piece, molded plastic, rectangularly shaped unit. Target 14 includes a planar ramp portion 22, a longitudinally, substantially level, rearwardly located portion or area 24, and peripheral, upstanding walls 25 on three sides of target 14. The fourth side of target 14 is open and at ground level.

Sheet 12 is supported by, and attached to (e.g. by a conventional adhesive) ramp portion 22 and level portion 24 such that ramp portion 22 elevates sheet 12 to level portion 24. A s seen in plan view in FIG. 2, at one end and a side periphery of ramp portion 22 and level portion 24 there is an L shaped gutter 26 having an end leg **26*a* and a side leg 26*b*. Gutter 26 slopes downwardly form the free end of gutter end leg 26*a* to the intersection with side leg 26*b*, and from that intersection to the free end of side leg 26*b***.

Level portion 24 of target 14 is provided with a circular hole 27 therethrough, which is in coaxial alignment with sheet hole 18. Exemplary diameters of holes 18 and 27 are 10 centimeters. Located under hole 18 is a retaining cup 32 having a bottom **32*a* that slopes downwardly in the forward direction (i.e. in the direction of the open side of target 14). At a forward part of one side of cup 32 is the entrance of a gutter 34. Gutter 34 extends transversely and forwardly from cup 32 towards L shaped gutter 26 until they merge or join at an intersection indicated at reference numeral 36. Gutter 34 also slopes downwardly from its free end located below hole 18 to intersection 36 and forms an acute angle of approximately 60 degrees with gutter 26**.

Ramp portion 22 and level portion 24 are supported by a frame 28 and together with gutters 26 and 34 are an integral part of molded target 14. In order to provide structural rigidity, support ribs 30 are provided in frame 28.

Located inside, in the bottom, of L shaped gutter 26 is a channel 38 that is substantially U-shaped in cross section with rounded upper edges. Channel 38 is located in the center and runs the entire length of gutter 26 as illustrated in FIG. 4. At the opening or end portion of gutter 26, channel 38 narrows and becomes flush with the bottom of gutter 26 at a location denoted 46. This narrowing of channel 38 allows for a smooth transfer of ball 40 from gutter 26 to return track 16.

Similarly, the bottom of gutter 34 is provided with a similarly shaped channel 42 that is located in the center and runs the entire length thereof. Channel 42 extends into a forward edge portion of the bottom of cup 32 and is spaced from the forward cup wall by a distance of about one half the diameter of golf ball 40. Thus, ball 40, falling through hole 32, is guided by the downwardly sloping bottom of cup 32 to the forward portion of the cup wall, then onto the end of channel 42 in the cup bottom, and from cup 32 into gutter 34. Channels 38 and 42 join at an intersection 44. As may be seen in FIGS. 2 and 3, channel 42 widens when it joins channel 38 at point 44. This allows for ball 40 to change direction with a minimal loss of momentum. Additionally, at a bend 58 in channel 38, located at the intersection of end leg **26*a* and side leg 26*b* of gutter 26, channel 38 widens and becomes shallower. The widening and becoming shallower of channel 42 permits a golf ball 40 to change direction in gutter 26** with a minimum loss of momentum of the ball.

In a preferred embodiment, channel 38 is 1 cm. wide and 0.5 cm. deep. Channel 38 is located in the middle of gutter 26 which is 5 cm. wide. In a similar fashion, channel 42 is 1 cm. wide and 0.5 cm deep. Channel 42 is also located in the middle of gutter 34 which is also 5 cm. wide. Because the diameter of a conventional golf ball is a little less than 4.5 cm., the edges of channels 38 and 42 are slightly more than one half the diameter of a golf ball 40 from the wall of the channel, such as shown in FIG. 4. Thus, channel 38 is just wide enough to guide a golf ball 40 down gutter 26 without significantly increasing the friction upon ball 40. At bend 58, channel 42 widens to about 2 cm. and this width is appropriate to redirect the travel of ball 40 without ball 40 jumping the track and also without a significant loss in velocity.

Figure 2:
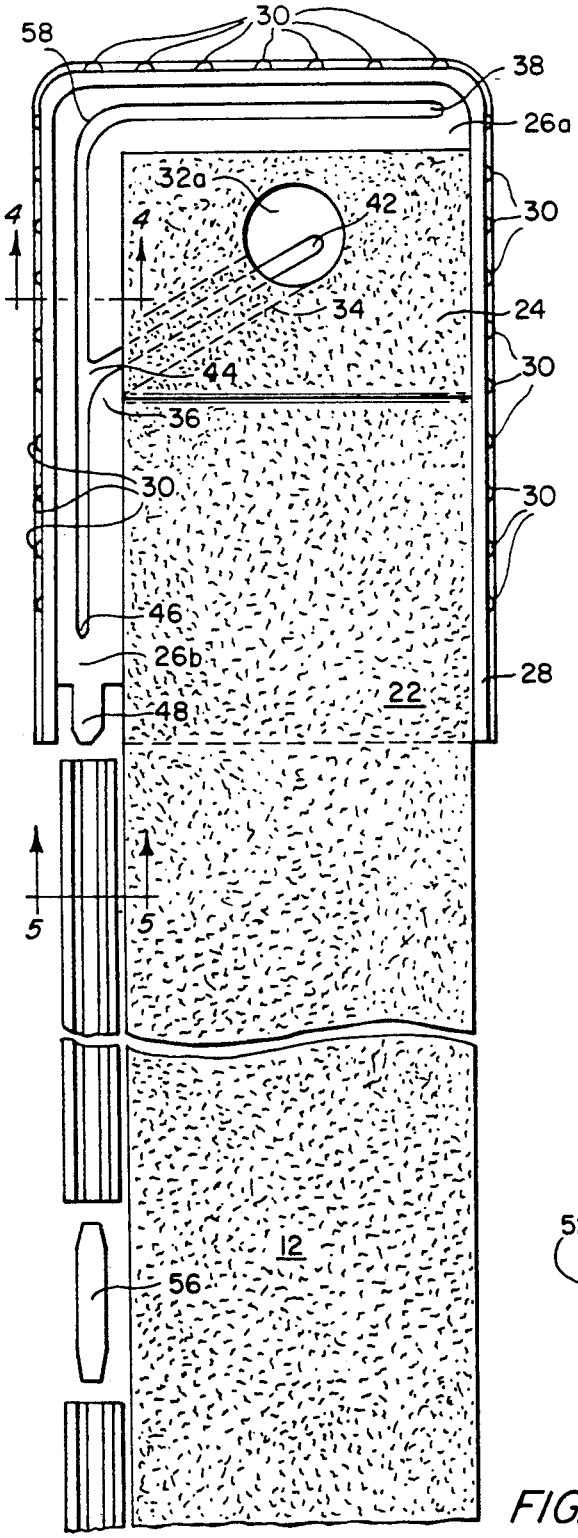
FIG. 2 is a top plan view of the trainer of FIG. 1.
Figure 3:
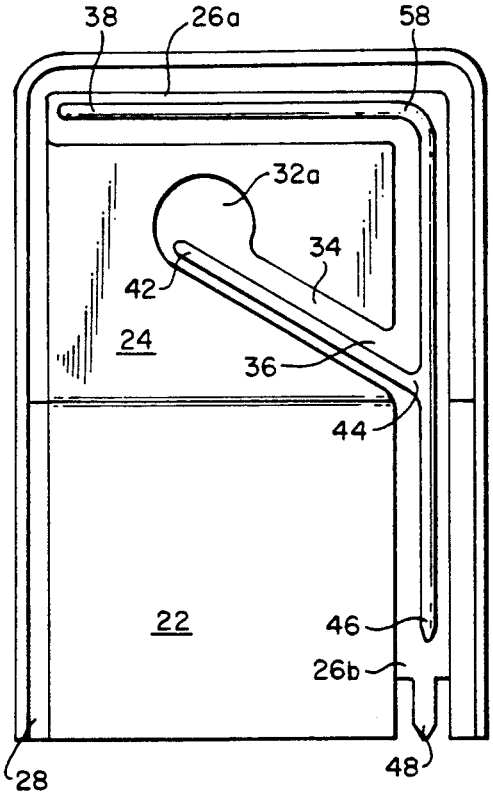
FIG. 3 is a bottom plan view of part of the trainer of FIG. 1.
Figure 5:
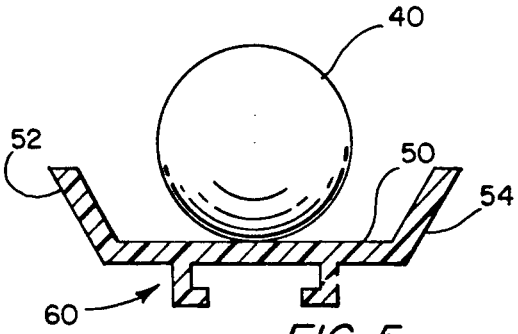
FIG. 5 is an enlarged cross-sectional view taken along lines 5—5 in FIG. 2 of a track of the trainer of FIG. 1 showing the positioning of a golf ball.

Extending from the end of and integrally attached to the bottom of gutter 26 is a tongue or sliver 48. Sliver 4 is pointed at one end so that it can more easily engage a groove or slot 60 on the underside of track 16 in a tongue and groove engagement. Track 16 has a substantially flat base 50. Attached to base 50 are two upstanding rails 52 and 54, one located on either side of base 50. Track 16 may be adjusted to any length by connecting additional tracks as depicted in FIG. 2. In this case, a connection sliver 56 engages slots 60 on both the tracks 16. Sliver 56 has pointed portions at each end to facilitate the tongue and groove engagement of the tracks 16.

In operation, a golfer first sets up golf putting trainer 10. This entails first placing the target 14 on the ground. Then the elongated sheet 12 is unrolled to its full length. Next, the golfer attaches ball return track 16 by sliding track 16 into tongue and groove engagement with sliver 48. Additional tracks 16 can be connected by attaching sliver 56 to the free end of track 16 and then attaching another track 16 to the sliver 56. Thus, any length track can be established.

The golfer then places a golf ball 40 on sheet 12 and attempts to hit ball 40 into hole 18. If the ball enters hole 18, then the ball 40 will fall into cup 32. After entering cup 32, the ball 40 will engage channel 42. Because channel 42 and gutter 34 are sloped in the direction of gutter 26, ball 40 will be guided to gutter 26. When ball 40 reaches intersection 44, it changes direction and travels down channel 38. At the end of channel 38, ball 40 enters track 16 and continues to roll towards the golfer. The distance ball 40 travels on track 16 depends upon the friction of track 16 and the amount of the loss of its momentum.

If ball 40 fails to enter hole 18, it will either enter gutter 26 directly and then follow the path as described above, or it will roll down ramp portion 22 and back to the golfer.

Although the present invention has been described relative to a specific exemplary embodiment thereof, it will be understood by those skilled in the art that variations and modifications can be effected in these exemplary embodiments without departing from the scope and spirit of the invention.

What is claimed is:

1. A golf putting trainer comprising:

a ramp having a golf hole in an elevated section thereof;

a first gutter around at least a peripheral portion of said ramp for returning a golf ball;

a second gutter having a first end under said hole and a second end in communication with said first gutter for delivering a golf ball which enters said hole to said first gutter;

a track;

means for attaching one end of said track to said first gutter for returning the golf ball to a golfer; and a first guide means for preventing sideways movement of the golf ball in said first gutter and guiding the golf ball in said first gutter to said track.

2. The trainer claimed in claim 1 and further including a second guide means in communication with said first guide means for guiding the golf ball in said second gutter to said first guide means.

3. The trainer claimed in claim 2 wherein said second guide means is located in said second gutter.

4. The trainer claimed in claim 3 wherein said second guide means comprises a second channel.

5. The trainer claimed in claim 4 wherein said second channel widens at a point where said second guide means is in communication with said first guide means.

6. The trainer claimed in claim 1 wherein said ramp further comprises a substantially horizontal surface in the vicinity of said golf hole.

7. The trainer claimed in claim 1 wherein said golf putting trainer further comprises an elongated sheet having at least one orifice therethrough, said orifice corresponding to said golf hole and being in coaxial alignment therewith and said sheet is attached to and supported by said ramp.

8. The trainer claimed in claim 7 wherein said first guide means comprises a first channel.

9. The trainer claimed in claim 8 wherein said first channel narrows to a point proximate to the junction of said gutter and said track.

10. The trainer claimed in claim 1 wherein said first gutter is L shaped in plan view; and wherein said first gutter slopes downward to said end at which said track is attached.

11. The trainer claimed in claim 1 wherein said second gutter slopes downwardly from said first end to said second end.

12. The trainer claimed in claim 1 wherein said track comprises at least one fixed length track wherein each fixed length track comprises a substantially flat base; two rails, one attached to either side of said flat base; and an attachment means for attaching another fixed length track.

13. The trainer claimed in claim 12 wherein said attachment comprises a projecting tongue which can be engaged with said track thereby providing a tongue and groove assembly.

14. The trainer claimed in claim 1 wherein said first guide means is located in said first gutter.

15. The trainer claimed in claim 1 wherein said means for attaching comprises a projecting tongue, integrally connected with said first gutter, for providing a tongue and groove connection to said track.

16. A golf putting trainer comprising:

a ramp having a golf hole in an elevated section thereof;

a first gutter around at least a peripheral portion if said ramp to return a golf ball;

a second gutter having a first end under said hole and a second end in communication with said first gutter to deliver a golf ball which enters said hole to said first gutter;

a track;

means for removably attaching one end of said track to said first gutter for returning the golf ball to a golfer; and guide means for preventing sideways movement of the golf ball in said second gutter and guiding a golf ball in said second gutter to said first gutter.

17. The trainer claimed in claim 16 wherein said ramp is a one piece molded plastic; and wherein said guide means is located in said second gutter and comprises a channel in the bottom of said gutter, said channel having a width that is from about $\frac{1}{4}$ to $\frac{1}{3}$ the diameter of a golf ball.

18. A golf putting trainer comprising:

a ramp for elevating at least one golf hole, said ramp having substantially horizontal surface in the vicinity of said golf hole;

a first gutter around a periphery of said ramp for returning a golf ball;

a second gutter having a first end under said hole and a second end in communication with said first gutter for delivering a golf ball which enters said hole to said first gutter;

a track attached at one end to said first gutter for returning the golf ball to a golfer;

a first guide means for preventing sideways movement of the golf ball in said first gutter and guiding the golf ball in said first gutter to said track, wherein said guide means comprises a first channel located in said first gutter;

a second guide means in communication with said first guide means for preventing sideways movement of the golf ball in said second gutter and guiding the golf ball in said second gutter to said first guide means, wherein said second guide means comprises a second channel located in said second gutter; and means for attaching said track to said first gutter, wherein said means for attaching comprises a projecting tongue, integrally connected with said first gutter, engaged with a groove on said track thereby providing a tongue and groove assembly.

19. The trainer claimed in claim 18 wherein said track comprises a flat base, two rails, one attached to either side of said flat base, and a means for attaching another track;

a first guide means for guiding the golf ball in said first gutter to said track, wherein said guide means comprises a first channel located in said first guide means;

a second guide means in communication with said first guide means for guiding the golf ball in said second gutter to said first guide means, and comprises a second channel located in said second guide means; and means for attaching said track to said first gutter, wherein said means for attaching comprises a sliver integrally connected with said first gutter and said sliver connected to said track in a tongue and groove manner.

20. The trainer claimed in claim 19 further comprising an elongated sheet having at least one hole through said sheet and corresponding to said golf hole; and wherein said sheet is attached to and supported by said ramp.

* * * * *